US008943720B2

(12) United States Patent
Kuo

(10) Patent No.: US 8,943,720 B2
(45) Date of Patent: Feb. 3, 2015

(54) MESSAGE-DELIVERY MEDIUM WITH CONCEALED INFORMATION

(76) Inventor: Fang-Lin Kuo, Hsin Chu (TW)

( * ) Notice: Subject to any disclaimer, the term of this patent is extended or adjusted under 35 U.S.C. 154(b) by 0 days.

(21) Appl. No.: 12/917,334

(22) Filed: Nov. 1, 2010

(65) Prior Publication Data

US 2011/0099867 A1 May 5, 2011

(30) Foreign Application Priority Data

Nov. 2, 2009 (TW) ..... 98137286 A

(51) Int. Cl.

| | |
|---|---|
| ***G09F 1/00*** | (2006.01) |
| ***G09F 1/04*** | (2006.01) |
| ***B42D 15/02*** | (2006.01) |
| *B42D 15/04* | (2006.01) |

(52) U.S. Cl.

CPC ..... *G09F 1/04* (2013.01); *B42D 15/025* (2013.01); *B42D 15/022* (2013.01); *B42D 15/045* (2013.01)

USPC ..... 40/124.01; 40/124.11; 40/124.191; 283/100; 283/101

(58) Field of Classification Search

USPC ..... 40/124.01, 124.11, 124.191; 283/100, 283/101

See application file for complete search history.

(56) References Cited

U.S. PATENT DOCUMENTS

| | | | | |
|---|---|---|---|---|
| 4,826,211 | A * | 5/1989 | Sinnott et al. | 283/117 |
| 5,037,099 | A * | 8/1991 | Burtch | 273/139 |
| 5,257,823 | A * | 11/1993 | Colvin et al. | 283/117 |
| 6,254,138 | B1 * | 7/2001 | Rawlings et al. | 283/81 |
| 2003/0225584 | A1 * | 12/2003 | Kraker | 705/1 |
| 2006/0289613 | A1 * | 12/2006 | Rocco | 229/92.8 |
| 2007/0262520 | A1 * | 11/2007 | Martineck | 273/138.1 |
| 2008/0114696 | A1 * | 5/2008 | Singh et al. | 705/66 |
| 2009/0014951 | A1 * | 1/2009 | Gough | 273/138.1 |
| 2009/0015001 | A1 * | 1/2009 | Haldorsen | 283/102 |
| 2009/0224528 | A1 * | 9/2009 | Kim | 283/72 |
| 2011/0139332 | A1 * | 6/2011 | Gilbert | 156/62.2 |

* cited by examiner

*Primary Examiner* — Gary Hoge

(57) ABSTRACT

A message-delivery medium with concealed information functions as a tool to promote personal relationships and connections between a sender and receiver, and comprises a message carrier and removable covering element. The message carrier carries an integrated message, which is known and designed/planned beforehand by the sender, and which contains a multiple of interrelated message elements having relativity and connectivity with each other. The message elements include at least one visible message and at least one concealed message that is hidden, yet known to the sender, such as a key message and/or an answer. The removable covering element is integrated with the surface of the message carrier, and hides the concealed message that is intentionally chosen to be hidden, thus preventing the receiver to see the concealed message. The receiver experiences feelings and/or emotional reactions planned, designed or expected by the sender, before, during and after removing the covering element.

17 Claims, 4 Drawing Sheets

MESSAGE-DELIVERY MEDIUM WITH CONCEALED INFORMATION

BACKGROUND OF THE INVENTION

1. Field of the Invention

The present invention consists of a message-delivery medium with concealed information, which promotes personal relationship, enhance emotional connection and increase interaction between the sender and the receiver, particularly with regards to a message-delivery medium with concealed messages to be disclosed by the receiver, which can stimulate the receiver to experience the emotional reactions planned and expected by the sender while the receiver reads the concealed messages.

2. Description of the Related Art

Many people use a card, such as a postcard or a greeting card, to deliver messages and enhance emotional interaction with others. Sometimes, a card is given along with a gift to express messages the sender intends to deliver to the receiver. Currently in the market, there are many products, by using printing methods or other production techniques, integrate words, symbols or patterns to the surface of the card, to express and communicate the intended message, while improving the esthetics appeal of the product.

For instance, current postcards, and greeting cards are designed according to convey different themes, festival seasons and occasions. The cards usually add decorative designs onto the surface and use theme-related words, pictures and messages, in order to attract consumers' willingness to purchase.

In the conventional cards, all messages are directly presented on the surface of the cards. In other words, the receiver can directly read all the messages and enjoy the novel designs displayed on the surface of the card. However, it seems difficult for the receiver to experience more unexpected surprises from the abovementioned conventional cards. Thus, some manufacturers developed some 3D cards and optoelectronic cards to enhance the added-value of the cards, while increasing the fun factor of the card itself or the effect of the messages conveyed.

The abovementioned types of cards were developed, and have existed in the market long time ago. Despite the persistent efforts of manufacturers to develop new creative card, no breakthrough card product has been witnessed thus far.

Thus, the present invention intends to propose a message-delivery medium with concealed information, applicable to cards or various gifts, which can promote personal relationship, connection and interaction between the sender and the receiver, wherein the concealed-information design can stimulate the receiver to experience, through the process of reading and interacting with the card, emotional surprises or contrasts, which the sender has planned or designed beforehand.

The conventional scratch cards also have an element of concealed-message design. However, the concealed-message design in conventional scratch cards is used for commercial purposes, to conceal prizes, secret codes, or confidential data.

The message-delivery medium with concealed information of the present invention also has a concealed-message design. However, the application of the concealed-message design of the present invention is very distinct from that of the conventional scratch cards. The concealed-message function of the present invention is not used for commercial purposes to conceal prizes or confidential data, but used as a tool to promote personal connection between the sender and the receiver. More specifically, the concealed-message design in the present invention is used to deliver messages of love or friendship, enhancing emotional connection or interaction, and strengthening personal relationship between the sender and receiver. Furthermore, the message-delivery medium with concealed information is used especially to stimulate the receiver to experience, through interaction with the card, feelings and/or emotional reactions that the sender expects, plans, or designs beforehand.

SUMMARY OF THE INVENTION

The primary objective of the present invention is to provide a message-delivery medium with concealed information, which functions as a gift or a message-delivery tool to promote personal relationship, emotional connection and interaction between the sender and the receiver, and which applies to products that may be but are not limited to greetings cards (such as postcards, celebration cards, theme cards, etc.), stationery products (such as books, pens, envelopes, notebooks, diaries, notepaper, sketchbooks, coasters, wrapping paper, calendars, etc.), fabric made items (such as clothing wear and decorative fabrics (including placemats and curtains, etc.)), decorative stickers (such as stickers, wall stickers).

The means to achieve the abovementioned objective is described below.

The message-delivery medium with concealed information of the present invention functions as a tool to promote personal/emotional connection between the sender and the receiver, and comprises:

a message carrier carrying an integrated message, which is known to the sender, and which can stimulate an anticipated feeling or emotional reaction from the receiver, and which contains a multiple of interrelated message elements having relativity and connectivity in meaning with each other, wherein the message elements include at least one visible message and at least one concealed message known to the sender that is intentionally chosen to be hidden; and a removable covering element integrated with the surface of the message carrier, covering the concealed message that is chosen to be hidden, and making the receiver unable to see the concealed message, wherein after the receiver removes the covering element from the message carrier, the concealed message reappears and can be read by the receiver.

Via the abovementioned technical scheme, the present invention can stimulate the receiver to have feelings or emotional reactions that the sender plans/designs and expects, before, during and after the receiver removes the covering element.

When present invention is produced into a commercially sold product, in order to inform consumers on the content of concealed message at point of purchase, and allow them to determine whether or not all conveyed messages on the message-delivery medium (including concealed messages) fulfills their need to buy the product, the message-delivery medium with concealed information of the present invention further comprises a message-informing device. The message-informing device may be a label at least presenting a key message consistent with the concealed message. The label may be an adhesive label stuck to the message-delivery medium itself or the packaging bag/box of the message-delivery medium. The message-informing device may be a display device presenting at the least a key message consistent with that of the concealed messages.

Each message element may consist of numbers, words, images, symbols, patterns, pictures, textures, color blocks, and/or combinations thereof. The message element may be an article stuck to or integrated with the message carrier, such as an adhesive sticker, an adhesive cloth piece, or any decorative article.

The material, contour, shape, color, pattern, and surface finish of the covering element are varied according to the overall design purpose of the message-delivery medium.

The covering element is made of a non-transparent material. The covering element may be in form of (1) a non-transparent adhesive piece that can be stuck to and peeled off from the surface of the message carrier; or (2) a non-transparent layer coated on the surface of the message carrier.

The message carrier may be in form of a card. The card may be a single-sheet card or a multi-sheet card containing a cover and at least one inside sheet. The inside sheet may be separated from the cover or integrated with the cover fixedly.

The material of the card may be but is not limited to paper, a plastic sheet, a metallic sheet, or a sheet made of composite materials.

The message carrier may be but is not limit to a gift product or a message-delivery article, such as stationery products, fabric made items, or decorative stickers.

DETAILED DESCRIPTION OF THE INVENTION

Below, the embodiments are described in detail to demonstrate the technical contents of the present invention. The present invention is a technology that may be widely applied to various objects. While the present invention is exemplified in actual form with cards below, the present invention however, is not limited to the application to cards only.

Figure 1:
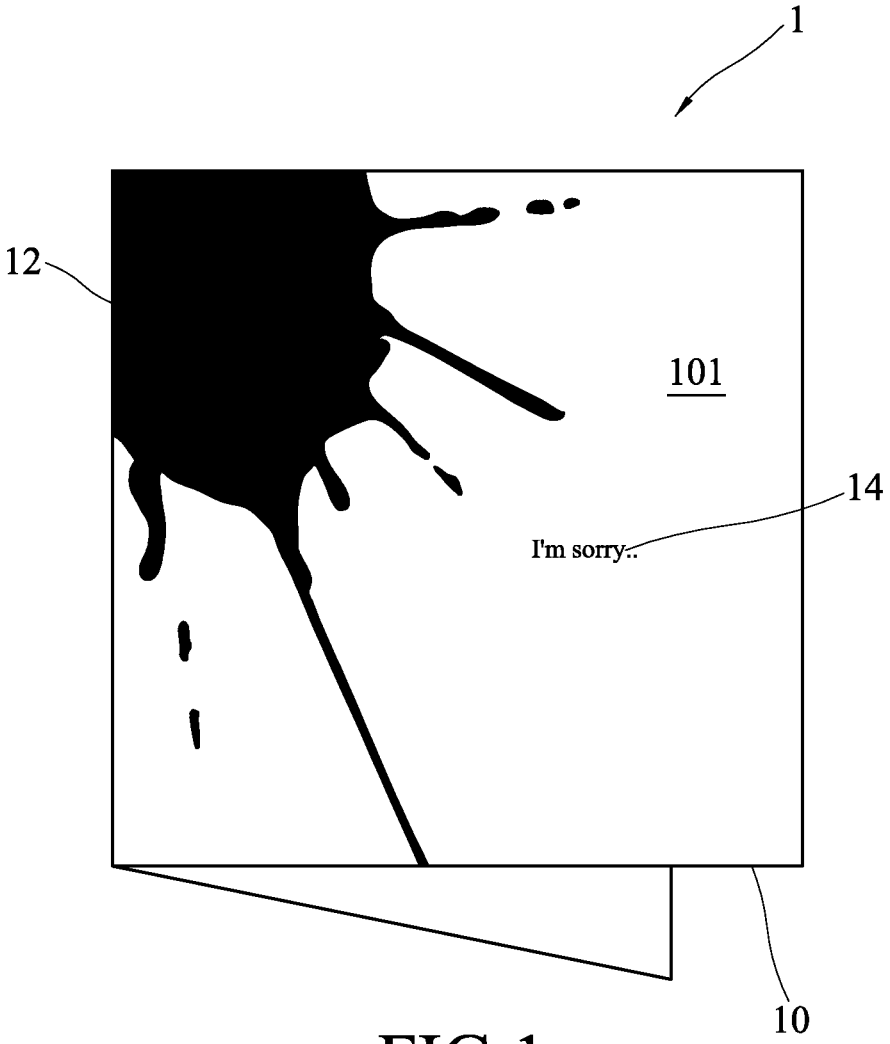
FIG. 1 is a perspective view schematically showing an unexpanded card according to one embodiment of the present invention.
Figure 2:
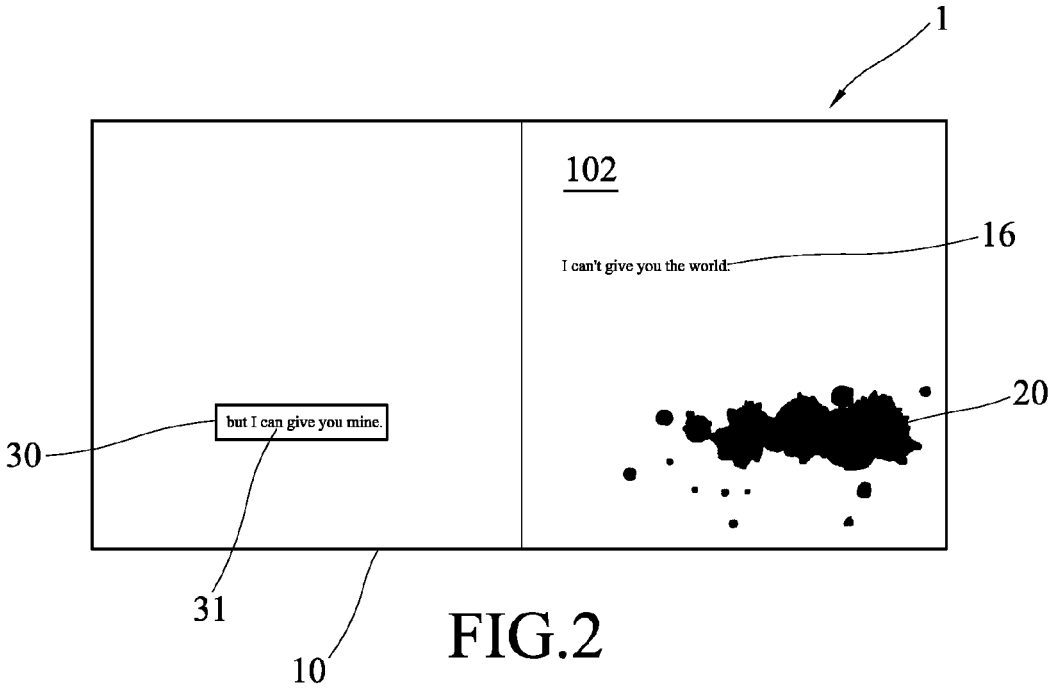
FIG. 2 is a diagram schematically showing that the card shown in FIG. 1 is expanded.

It should be emphasized firstly that the present invention proposes a message-delivery medium with concealed information, which is used as a tool to promote personal connection between the sender and the receiver, and which provokes the receiver to experience, through interaction with the message carrier, feelings or emotional reactions the sender plans, designs and/or expects. Refer to FIG. 1 and FIG. 2 diagrams respectively schematically showing an unexpanded card and an expanded card according to one embodiment of the present invention. The message-delivery medium with concealed information of the present invention comprises a message carrier 10 and a removable covering element 20. The message carrier 10 carries an integrated message that is known to the sender, and which can stimulate the receiver to experience, through the reading process, and/or emotional reactions expected by the sender. In a broad sense, the integrated message may include the outlook design of the product itself, color design, material, or texture of the message carrier 10. The integrated message may further include numbers, words, characters, images, symbols, pictures, patterns, color blocks or combinations thereof, which are formed on or integrated with the message carrier 10 via an existing method, such as a printing method, an adhesive method, or a transfer-print method. The integrated message may further include an article attached to or integrated with the message carrier, such as an adhesive label or an adhesive cloth piece.

The integrated message presented on the message carrier 10 contains a multiple of message elements having relativity and connectivity in meaning with each other. The message elements include at least one visible message and at least one concealed message 18 that is chosen to be hidden. The removable covering element 20 is integrated with the message carrier 10 and covers the concealed message 18. Once the receiver removes the covering element 20 from message carrier 10, the concealed message 18 reappears and becomes visible to the receiver. The concealed message 18 may be integrated with or presented on the surface of the message carrier 10 as numbers, characters, words, images, symbols, pictures, patterns, color blocks or combinations thereof, via various existing technologies, such as a printing method, an adhesive method, and a transfer-print method. Alternatively, the concealed message 18 may be a blank message.

The covering element 20 may adopt a contour or shape that connects or relates to in a meaningful way with the outlook design, style or conveyed message of the message-delivery medium. The shape of the covering element 20 may be but is not limited to a shape selected from a group consisting of geometrical shapes, irregular shapes, patterned shapes, character-like shapes and combinations thereof. The covering element 20 may adopt various colors with different hues, brilliances and chrominances and/or adopts various patterns or textures to match the overall design purpose and style of the message-delivery medium.

Figure 3:
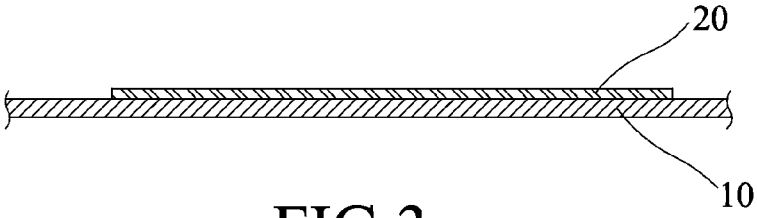
FIG. 3 is a sectional view schematically showing the expanded card shown in FIG. 2.

In order to conceal the message that is intended to be hidden 18, the covering element 20 should be made of a non-transparent material. Refer to FIG. 3. The covering element 20 may be non-transparent piece with various contour shapes and/or sizes according to the overall design purpose. The non-transparent piece may be a sticker, which has an adhesive back or is coated with glue on one side thereof, and which can be peeled off/removed from the message carrier 10. It is proposed that the covering element 20 may be made of a material or an already existing product that can be stuck onto and peeled off/removed repeatedly from the message carrier 10 without being damaged. Furthermore, the covering element 20 may be a non-transparent layer coated on the surface of message carrier 10 to cover the concealed message 18, while following the designed shape and area size of concealed message 18. The non-transparent layer can be scratched off with a coin or a hard object, or removed with an eraser or a detergent or cleaning substance.

When the message-delivery medium of the present invention is produced into a commercially sold product, the concealed message 18 is covered beforehand. In order to inform the consumers on the content of the concealed message 18, and allow them to determine at point of purchase whether or not all the conveyed messages on the message carrier 10 (including concealed messages 18) fulfill their need to buy the product, the message-delivery medium with concealed information further comprises a message-informing device 30, which presents a key message 31. The key message 31 contains at the least information that is consistent with that of the concealed message 18. In other words, the message-informing device 30 functions like an answer or a solution provider, whereby consumers can clearly be informed of the content of concealed message 18, enclosed within message carrier 10.

In practice, the message-informing device 30 may be a label made of paper materials, plastic material, metallic materials and composite materials. The label should have sufficient area size to present key message 31, which is consistent with the concealed message 18 that is intended to be hidden in the message carrier 10. The label may be an adhesive label that can be stuck to the message carrier 10 or the packaging bag/box. It is proposed that the label is a material or an existing product that can be stuck onto and peeled off repeatedly from the message carrier 10 without being damaged.

Moreover, the message-informing device 30 is a display device (not shown in the drawings), such as a device having a LCD screen, a LED screen or a TFT screen, and the screen can present at the least the key message 31, which is consistent with the concealed message 18 that is intended to be hidden in the message carrier 10.

When in the form of a card, the message-delivery medium comprises a sheet-like flexible message carrier 10 carrying an integrated message, which the sender has planned or selected. Refer to FIG. 1 for an embodiment wherein the message-delivery medium is applied to a card. The card 1 has a message carrier 10, and the message carrier 10 contains a multiple of message elements having relativity and connectivity in meaning with each other. The message elements include an image pattern 12, which is located on a cover 101 of the message-carrier 10, and looks like a violent paint splash. The cover 101 also has a first visible message 14 "I am sorry . . . ". Refer to FIG. 2, after opening the message carrier 10, the consumer can see a second visible message 16 "I can't give you the world." (located on the center of the right page of inner page 102) and a covering element 20 that covers the concealed message 18 (located on the lower right page of inner page 102), both of which relate to the meaning of the first visible message 14. In this embodiment, the covering element 20 is a combination of several irregular shapes (a paint splash as shown). Because the covering element 20 is non-transparent, the concealed message 18 is invisible to the eye, until the covering element 20 is removed.

After receiving the card 1, which contains a multiple of integrated message elements having relativity and connectivity in meaning with each other, the receiver will read the visible messages respectively displayed on the cover 101 and inner pages 102. At this time, the receiver does not see the concealed message 18, covered by the covering element 20. Thus, the receiver may have an emotional reaction (such as a depressed emotion) and is curious about the content of concealed message 18, which is covered by the covering element 20. At this time, the receiver usually tries to guess the content of concealed message 18. At the same time, the receiver may have an anticipated answer and hopes that the concealed message 18 reveals his expected answer. During removal of the covering element 20, the receiver may feel anxious and uneasy until he completely removes the covering element 20, and learns the concealed message 18. Upon learning concealed message 18, the receiver is stimulated to have another emotional reaction. For example, after learning the concealed message 18, the receiver is moved, and feels comforted while the prior depressed emotion instantly vanishes and is quickly replaced by a happy state of emotion.

Figure 4:
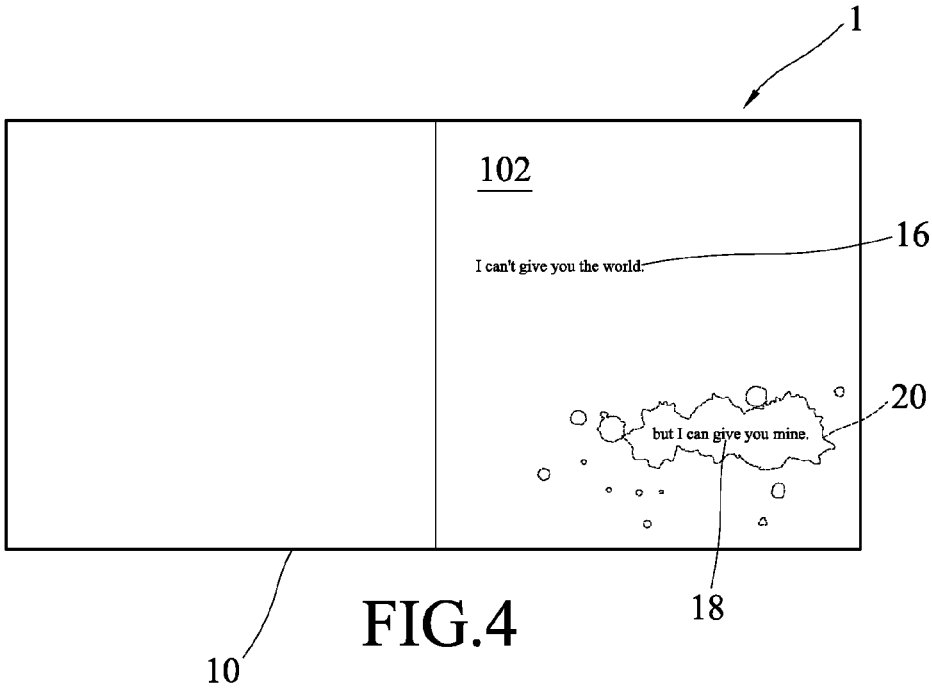
FIG. 4 is a diagram schematically showing that the covering element is removed from the inner page of the expanded card shown in FIG. 2.

Refer to FIG. 4. After the covering element 20 on the card 1 is removed, the concealed message 18 "But I can give you mine." is revealed. It provokes the receiver to experience a great emotional contrast or transition, which creates a long-lasting, unforgettable emotional experience.

In the abovementioned embodiment, a card 1 is used—as a message-delivery medium, and the integrated message designed or selected by the sender is presented on the message carrier 10 of the card 1. In addition, also by using the covering element 20 to intentionally hide the concealed message 18, this allows the receiver to experience feelings, emotional reactions and/or contrasts before, during and after revealing the concealed message 18.

Figure 5:
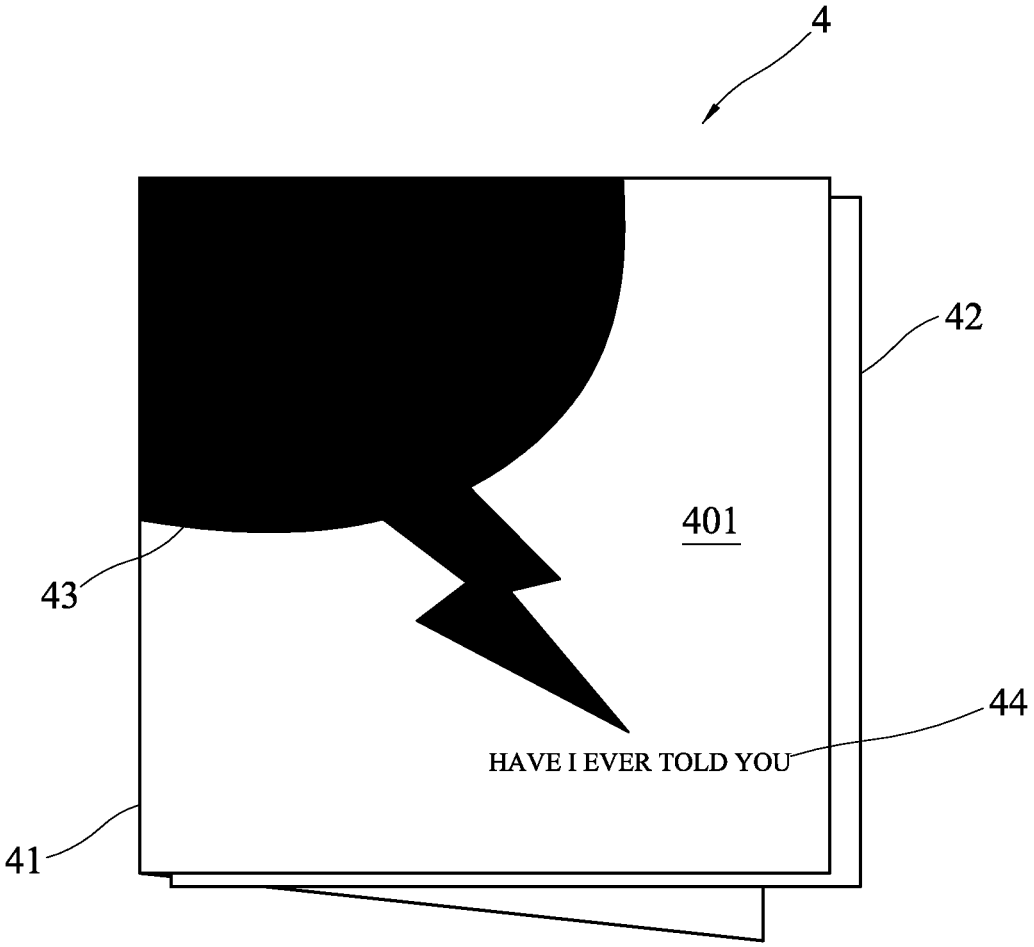
FIG. 5 is a perspective view schematically showing an unexpanded card according to another embodiment of the present invention.
Figure 6:
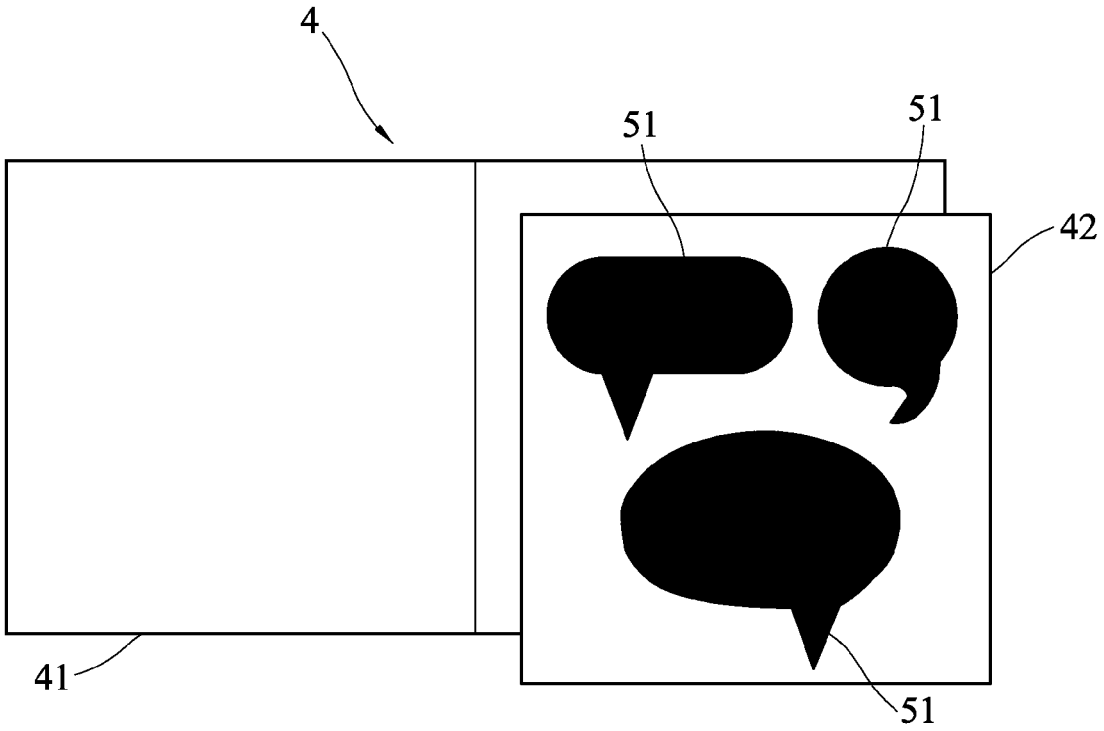
FIG. 6 is a diagram schematically showing that the card shown in FIG. 5 is expanded.
Figure 7:
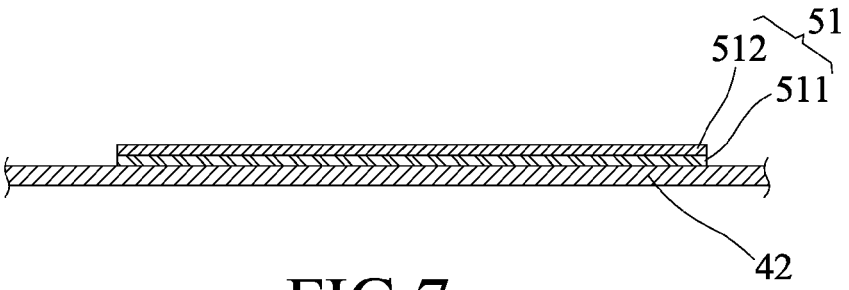
FIG. 7 is a sectional view schematically showing the expanded card shown in FIG. 6.

Refer to FIG. 5 and FIG. 6 wherein the present invention is applied to another type of card. In this embodiment, the sender can customize his own card 4. Different from the single-sheet card used in the preceding embodiment, a multi-sheet card including a cover and at least one inner sheet is used in this embodiment. The card 4 comprises sheet-like flexible message carriers, such as first message carrier 41 and a second message carrier 42 in this embodiment. The first message carrier 41 and second message carrier 42 carry the integrated message designed or selected by the sender. As shown in the drawings, the first message carrier 41 and the second message carrier 42 respectively carry message elements having relativity and connectivity in meaning with each other. The message elements include an image 43 (a conversation bubble) in a left upper position of a cover 401, and a first visible message 44 ("HAVE I EVER TOLD YOU") in the lower right position of cover 401, both of which are located on the first message carrier 41. After opening the first message carrier 41, the consumer can see several covering elements 51 (three different-shapes of conversation bubbles) on the second message carrier 42, which is originally inserted into first message carrier 41. In this embodiment, the covering elements 51 are adhesive labels that can be stuck onto and peeled off repeatedly. As shown in FIG. 7, the adhesive label includes a transparent layer 511 stuck to the second message carrier 42, whereby a non-transparent layer or piece 512 is coated on the transparent layer 511.

After purchasing the card 4, the sender can write planned concealed messages in the blank areas of inner page of the first carrier 41. The concealed messages added by the sender can be related and connected in meaning with the other message elements of card 4. Next, the sender peels off the covering elements 51 from the second message carrier 42, and sticks the covering elements 51 over the concealed messages on the first message carrier 41, making the concealed messages not visible to the eye for the receiver. Thereby, the receiver cannot see the concealed messages covered by the covering elements 51, unless the receiver peels off the covering elements 51 or removes/scratches off the non-transparent layer 512 that is above the transparent layer 511 of the covering elements 51.

After receiving the card, in which the sender added planned concealed messages, the receiver reads the visible messages on the cover 401 of the first message carrier 41, and is stimulated by the visible messages to experience an emotional reaction and/or is curious about the content of concealed messages, hidden underneath the covering element 51. At this time, the receiver usually tries to guess the content of the concealed message. At the same time, the receiver may have an anticipated answer and hopes that the concealed message reveals his expected answer. During removal of the covering element 51, the receiver may feel anxious and uneasy until he completely removes the covering element 51, and learns the concealed message. When the concealed message is completely revealed, the receiver is stimulated to have another emotional reaction.

From the above description, it is known that the message-delivery medium of the present invention indeed can promote personal relationship, interaction and connection between the sender and the receiver. The message-delivery medium of the present invention comprises a message carrier and a covering element. The message carrier carries an integrated message known or designed by the sender. The integrated message includes a multiple of message elements having relativity and connectivity in meaning with each other. The message elements include at least one visible message and at least one concealed message that is chosen to be hidden (such as a key message or an answer). The covering element is integrated with the surface of the message carrier. In addition, by using the covering element to hide the chosen concealed message, this abovementioned design allows the receiver to experience feelings, emotional reactions and/or contrasts planned and anticipated by the sender, when reading the visible messages, while disclosing the covering element, and after revealing the concealed messages.

Therefore, the present invention can stimulate the receiver to experience various emotional reactions and/or contrasts anticipated by the sender.

The conventional scratch cards and the message-delivery medium of the present invention are similar in that users disclose the concealed message via scratching off or removing the covering element. However, they are very different in application or function. Below are demonstrated the differences therebetween and the characteristics of the present invention.

1. The conventional scratch cards are different from the message-delivery medium in application:

The message-delivery medium of the present invention is dedicated to promoting personal relationship, interaction and connection between the sender and the receiver. The conventional scratch cards are commercially used as a tool to disclose information on prizes, or to conceal personal or confidential data.

The message-delivery medium of the present invention does not use design of removable or scratchable concealed information, for commercial purposes or simply to obtain private data, but purely is used as a tool to promote personal relationship or deliver personal messages, especially messages about friendship or love.

2. The concealed message with removable/scratchable feature of the conventional scratch cards and that of the message-delivery medium of the present invention respectively with different functions:

The present invention, the concealed information, embedded within the message carrier of the message-delivery medium, consists as a key and indispensible element of the integrated message, and completes the meaning of the planned or intended message as a cohesive whole. Moreover, concealed information of present invention consists of an answer that stimulates surprise, while provokes the receiver to experience anticipated emotional reactions and/or contrasts.

The conventional scratch cards simply conceal an independent answer or message that does not have direct/literal relativity or connectivity with any visible messages on the scratch card. However, the concealed message of the message-delivery medium of the present invention is pre-designed or planned to interrelate and connect with the other message elements on the message-delivery medium, and consist of a key element that completes the meaning of the planned integrated message as a cohesive whole.

Furthermore, the concealed message of the message-delivery medium of the present invention can stimulate the receiver to experience emotional reactions and/or contrasts before and after revealing the concealed message.

Unlike conventional scratch cards, the covering element that hides the concealed messages of the present invention has the following three functions in provoking and/or managing anticipated emotional reactions:

1) functioning as an important link between the visible messages on the message carrier and the concealed message;

2) generating emotional reactions and/or contrasts before and after disclosing the concealed message, and creating a surprising effect that is planned by the sender but unexpected by the receiver;

3) consisting of a key indispensible element in the integrated message, and completes the meaning of the intended integrated message as a cohesive whole. It allows the receiver, when disclosing the covering element and learning the concealed message, to experience the emotional reactions anticipated and planned by the sender, and receive the emotional interaction or connection the sender wishes to convey.

Contrarily, the covering element on conventional scratch cards does not have any extra function, but to merely hide data.

3. The present invention, by utilizing the covering element to hide concealed information, stimulates and/or manages the expected and planned emotional reactions:

The conventional scratch cards, such as lottery tickets or secret coded slips/bars, normally uses a silver-colored scratchable strip to cover the concealed message, in other words, the concealed message of the conventional scratch cards is merely a important piece of information required to be concealed.

However, the covering element used to hide the concealed messages of the present invention may have different colors, patterns, shapes, sizes and textures to accentuate its design. Moreover, to achieve the stimulated and/or expected/planned emotional reactions, the covering element of the present invention may use the following methods:

1) relating in meaning to words, colors, patterns, images, etc., presented on the i message carrier of the message-delivery medium;

2) creating effect of contrast or surprise from the meaning of message elements (such as words, colors, images, pictures, etc.) presented on the message carrier, thus provoking emotional reactions;

3) using irregular shapes.

4. The concealed message in the message carrier is intentionally designed and planned to stimulate emotional reactions that the receiver does not expect, while the receiver experiences emotional reactions or transition before, during and after disclosing the concealed message. The concealed message may use below but not limited to the following methods, to achieve above-mentioned intended effect: to achieve such 1) use the concealed message as an indispensable key factor to complete the meaning of intended integrated message of the message carrier, and create unexpected emotional reactions and/or contrasts;

2) use the concealed message to relate or connect with words, patterns, colors, or images presented on the message carrier of the message-delivery medium;

3) use the concealed message as an answer that relates to the other message elements in the message carrier;

4) use the concealed message as a key message that completes the meaning of the integrated message as a cohesive whole; and 5) use a combination of above methods.

The message-delivery medium of the present invention can use infinite ways to design, plan and provoke unexpected emotional surprises and/or reactions. Moreover, the covering element is carefully and purposefully planned and designed to play the key role, which discloses an answer that creates unexpected answer of surprise or emotional contrast. Hence, the receiver will experience emotional reactions and/or contrasts before, during and after disclosing the concealed message, such as a transition from a depressed emotional state to a happy state, from a happy state to a depressed state, or from a neutral state to a stimulated state.

Therefore, the message-delivery medium of present invention can stimulate the receiver to experience an emotional transition and/or contrast that is unexpected to the receiver, but is intentionally planned and anticipated by the sender. When disclosing the concealed message, the receiver will have an emotional transition from curiousness to excitement or from a sad/depressed state to a touched/emotionally touched state.

Distinct from the present invention, the covering element of the conventional scratch card is merely to hide the result of a game/gamble, or confidential data. Further, the concealed message of the conventional scratch card is not planned to be given to a specified reader or receiver.

5. The concealed message and the covering element of the message-delivery medium of the present invention both consist of key elements of the message carrier. Furthermore, there is interrelation and connection in meaning between the concealed message and the covering element:

As to interrelation between concealed message and covering element:

1) The concealed message and the covering element are both related in meaning to all message elements on the message carrier, including the color and shape of the message carrier itself, or the words, patterns, colors and blank areas presented on the message carrier. The concealed message and the covering element can be located in any position but not limited to the front side or back side of the message carrier.

2) After the covering element is removed, the concealed message is disclosed, to function as a key element that completes the meaning of the intended integrated message as a cohesive whole, and/or highlights the meaning of the message the sender intends to deliver.

3) The covering element and the concealed message are indispensible components of the message carrier. They are also critical elements interlinking with the other message elements on the message carrier. Once the concealed message is disclosed, the meaning which the sender intends to deliver via the message carrier can be fully and completely understood.

As to connection between the concealed message and the covering element:

The concealed message and the covering element both have connection with surrounding patterns and content of messages in the message carrier. The concealed message is to the last piece of the jigsaw puzzle. The intended integrated message of the message carrier is not complete until the covering element is removed to reveal the concealed message. In other words, the covering element and the concealed message are critical factors to complete the meaning of the message carrier as a cohesive whole. The concealed message functions as a key. The meaning of messages of the message carrier cannot be fully understood unless the concealed message is disclosed.

6. The process of disclosing the concealed message can stimulate the receiver to have emotional reactions which the sender expects:

The concealed message may be but is not limited to words, patterns, colors, images and others. The concealed message may stimulate the receiver to experience feelings such as curiosity, anticipation, excitement and suspense. Before, during and after disclosing the concealed message, the receiver will have different emotional reactions in each of these three phases. For example, before and after disclosing the concealed message, the receiver may experience feelings from sadness to happiness, worried to excitement, depressed to humored, excitement, astonishment, emotionally touched and so on.

In the case of conventional scratch cards, the receiver does not experience the planned, designed and expected feelings and/or emotional reactions during the disclosure of the concealed message, as the emotional experience the present invention would provide.

7. From the above description, it is known: The message-delivery medium of the present invention is an interactive medium between the sender and the receiver, wherein the message-delivery medium can stimulate the receiver to have emotional reactions planned by the sender. Compared with the conventional scratch cards, the message-delivery medium of the present invention further has the following characteristics:

1) Infinite number of outcomes: The concealed message of the conventional scratch card has only one result: win or lose, or simply a piece of confidential information. However, the concealed message of the present invention is not limited to an outcome of win or lose, nor a specific confidential data. The concealed message can be designed in diverse manners to create different meanings and messages intended to stimulate diverse emotional reactions, therefore resulting in infinite number of outcomes. 2) Souvenir to be kept and cherished for long-term basis: The message carrier of the present invention, stimulates the receiver to experience, through the design of concealed information, significant emotions provoked, especially when disclosing the concealed information. Thus, the receiver will keep the message carrier as a souvenir to cherish, and a reminder of the meaningful relationship or connection between the sender and receiver. 3) Concealed message/answer known by sender: The message-delivery medium of the present invention has a covering element that hides the concealed message. However, when the present invention is produced to be commercially sold, a message-informing label/device will be included in message-delivery medium, in order to inform consumers on the content of the concealed message.

The embodiments described above are only to exemplify the present invention, but does not limit the scope of the present invention. Any equivalent modification or variation according to the spirit of the present invention is to be also included within the scope of the present invention.

What is claimed is:

1. A message-delivery medium with concealed information, comprising:

a message carrier having at least one visible message and at least one concealed message, said visible message and said concealed message are different from each other;

a removable covering element covering said concealed message; and a message-informing device non-integral with said message carrier and presenting a key message, said key message being non-removable, uncovered, and printed directly on said message-informing device, wherein said key message is identical to said concealed message, the key message revealing to a sender of said message carrier the concealed message without having to remove said removable covering element.

2. The message-delivery medium with concealed information according to claim 1, wherein each said visible message and said concealed message is selected from a group consisting of numbers, words, images, symbols, textures, color blocks, and combinations thereof.

3. The message-delivery medium with concealed information according to claim 1, wherein each said visible message and said concealed message is an article attached to or integrated with said message carrier.

4. The message-delivery medium with concealed information according to claim 1, wherein said covering element has a contour or shape selected from a group consisting of geometrical shapes, irregular shapes, patterned shapes, character shapes, and combinations thereof.

5. The message-delivery medium with concealed information according to claim 1, wherein said covering element is non-transparent.

6. The message-delivery medium with concealed information according to claim 5, wherein said covering element is a patch that is stuck to said message carrier and can be peeled off from said message carrier.

7. The message-delivery medium with concealed information according to claim 6, wherein said covering element further comprises a transparent layer and a non-transparent layer overlaid upon and integrated with said transparent layer.

8. The message-delivery medium with concealed information according to claim 1, wherein said covering element is a non-transparent layer coated on said message carrier and can be scratched off from said message carrier.

9. The message-delivery medium with concealed information according to claim 8, wherein said covering element further comprises a transparent layer and a non-transparent layer overlaid upon and integrated with said transparent layer.

10. The message-delivery medium with concealed information according to claim 1, wherein said message carrier is a card.

11. The message-delivery medium with concealed information according to claim 10, wherein said card is a single page of card.

12. The message-delivery medium with concealed information according to claim 10, wherein said card includes a cover and a inner sheet.

13. The message-delivery medium with concealed information according to claim 1, wherein said message carrier is a stationery product, a fabric item, or a adhesive label.

14. The message-delivery medium with concealed information according to claim 1, wherein said message-informing device is a label.

15. The message-delivery medium with concealed information according to claim 14, wherein said message-informing device is an adhesive label.

16. The message-delivery medium with concealed information according to claim 1, wherein said message-informing device is a display device.

17. The message-delivery medium with concealed information according to claim 1, wherein said covering element has an image selected from a group consisting of words, colors, patterns, images, and combinations thereof.

* * * * *